US007128033B2

(12) United States Patent
Yamauchi

(10) Patent No.: US 7,128,033 B2
(45) Date of Patent: Oct. 31, 2006

(54) VALVE DRIVING APPARATUS AND INTERNAL COMBUSTION ENGINE INCLUDING THE SAME

(75) Inventor: Kosaku Yamauchi, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 384 days.

(21) Appl. No.: 10/746,335

(22) Filed: Dec. 23, 2003

(65) Prior Publication Data

US 2004/0134454 A1 Jul. 15, 2004

(30) Foreign Application Priority Data

Dec. 24, 2002 (JP) ..... 2002-372446

(51) Int. Cl.
*F01L 1/02* (2006.01)

(52) U.S. Cl. ..... 123/90.31; 123/90.18; 123/90.17; 123/90.15

(58) Field of Classification Search ..... 123/90.16, 123/90.15, 90.17, 90.31, 90.18
See application file for complete search history.

(56) References Cited

U.S. PATENT DOCUMENTS 6,530,351 B1 * 3/2003 Mikame ..... 123/90.15
2001/0054403 A1 12/2001 Fujii et al.

FOREIGN PATENT DOCUMENTS

DE 29 50 656 A1 6/1981
JP 2002-364319 A1 12/2002
JP 2003-003811 A1 1/2003
JP 2003-003812 A1 1/2003
JP 2003-041914 A1 2/2003
JP 2003-201814 A1 7/2003

OTHER PUBLICATIONS

Office Action dated Jul. 19, 2005 for German Patent Application No. 103 61 199-1-13.
Patent Abstracts of Japan for JP04-187807 published Jul. 6, 1992.
Patent Abstracts of Japan for JP2003-003811 published on Jan. 8, 2003.
Patent Abstracts of Japan for JP2002-364319 published on Dec. 18, 2002.
Patent Abstracts of Japan for JP2003-003812 published on Jan. 8, 2003.
Patent Abstracts of Japan for JP2003-041914 published on Feb. 13, 2003.
Patent Abstracts of Japan for JP2003-201814 published on Jul. 18, 2003.

* cited by examiner

*Primary Examiner*—Thomas Denion
*Assistant Examiner*—Zelalem Eshete
(74) *Attorney, Agent, or Firm*—Darby & Darby

(57) ABSTRACT

A cam 13 formed so that cam height and a cam operation angle continuously change, and constituted to be rotated integrally with a camshaft 11 and relatively movable in an axial direction thereof, a valve lifter 20 pressed by a cam surface of the cam 13 to advance and retreat a valve, and an accelerator shaft unit 40 for moving the cam 13 in the axial direction of the camshaft 11 are included. The accelerator shaft unit 40 includes an accelerator shaft 41 placed to be capable of reciprocating in the axial direction of the camshaft, and an accelerator fork 42 supported at the accelerator shaft 41 and engaging with the cam 13, and has an adjust mechanism 70 for finely adjusting a relative position in an axial direction of the accelerator fork 42 with respect to the accelerator shaft 41.

8 Claims, 9 Drawing Sheets

VALVE DRIVING APPARATUS AND INTERNAL COMBUSTION ENGINE INCLUDING THE SAME

CROSS-REFERENCE TO RELATED APPLICATIONS

This application is based upon and claims the benefit of priority from the prior Japanese Patent Application No. 2002-372446, filed on Dec. 24, 2002, the entire contents of which are incorporated herein by reference.

BACKGROUND OF THE INVENTION

1. Field of the Invention

The present invention relates to a valve driving apparatus for performing variable control of a lift amount, lift timing and an actuated angle in accordance with an accelerator opening in an internal combustion engine in a motorcycle, an automobile or the like.

2. Description of the Related Art

In this type of internal combustion engine, combination of a variable phase and cam switching begins to appear recently, and thereafter, a method with use of a three dimensional cam for making the actuated angle and the lift amount continuously variable is proposed. For example, there is a method in which a follow-up mechanism for a change in a contact angle is provided at a top portion of a direct striking type cylinder tappet, and by sliding the three-dimensional cam in an axial direction, the valve lift amount is made continuously variable.

This type of three-dimensional cam is provided extensively with a cam portion gradually inclined in a longitudinal direction (axial direction of a camshaft), and is formed in a shape to continuously change the valve lift amount. In this case, setting is made such that a cam operation angle and lift timing are changed synchronously with cam height, namely, the cam operation angle becomes larger as the valve lift amount becomes larger, and the lift timing of the valve is capable of being changed. By moving such a cam along the camshaft, the lift amount, the actuated angle and lift timing of an intake valve can be controlled to be continuously variable via the valve lifter including the tappet.

By applying such a three-dimensional cam to, for example, the intake valve at an intake side, a throttle valve to form a mixture is eliminated, and a so-called non-throttle valve engine can be realized. Incidentally, when fine adjustment of the valve lift amount is performed, or tuning of cylinders is performed in a multi-cylinder engine, fine adjustment of a tappet guide is performed in a slide direction of the cam with use of, for example, an eccentric cam in the prior art.

On the occasion of fine adjustment of the valve lift amount (intake boost) or tuning of the cylinders as described above in the above prior art, fine adjustment or tuning is performed with a cylinder head cover being removed from a cylinder head. In this case, if fine adjustment is performed for an intake boost with the engine being rotated, lubricant oil easily scatters, and therefore it is necessary to prevent scattering of oil with use of a special tuning cover. When tuning is performed without rotating the engine, it is necessary to use a device for measuring the valve lift amount in the cylinder head unit.

Further, on the occasion of maintenance of the cylinder head unit in a maintenance service and the like after manufacture and shipment, there is no other way except for taking the method for preventing scattering of oil by removing the cylinder head cover and using the tuning cover, and tuning cannot help being performed at much expense in time and effort.

SUMMARY OF THE INVENTION

In view of the above circumstances, the present invention has its object to provide a valve driving apparatus capable of performing fine adjustment of a valve lift amount simply and efficiently and an internal combustion engine including the same.

The valve driving apparatus of the present invention is a valve driving apparatus comprising a cam formed so that cam height and a cam operation angle continuously change, and constituted to be rotated integrally with a camshaft and relatively movable in an axial direction thereof, a valve lifter pressed by a cam surface of the aforesaid cam to advance and retreat a valve, and an accelerator shaft unit for moving the aforesaid cam in the axial direction of the camshaft, and characterized in that the accelerator shaft unit comprises an accelerator shaft placed to be capable of reciprocating in the axial direction of the camshaft, and an accelerator fork supported at the accelerator shaft and engaging with the aforesaid cam, and has an adjust mechanism for finely adjusting a relative position in an axial direction of the accelerator fork with respect to the accelerator shaft.

The valve driving apparatus of the present invention is characterized in that the adjust mechanism has an adjust lever rotatably supported on the accelerator shaft and engaging with the accelerator fork to move it slightly in the axial direction of the accelerator shaft, and finely adjusts a position in an axial direction of the accelerator fork by rotating movement of the adjust lever.

The valve driving apparatus of the present invention is characterized in that the adjust mechanism is constituted so that the rotating movement of the adjust lever is capable of being handled from an outside of a cylinder head or a cylinder head cover.

The valve driving apparatus of the present invention is characterized in that the accelerator shaft is commonly used for at least two parallel cylinders, an accelerator fork placed at one of the cylinders is fixed to the accelerator shaft, and a position in an axial direction of the accelerator fork placed at the other cylinder is finely adjusted.

The valve driving apparatus of the present invention is characterized in that the adjust mechanism has a rotational driving mechanism engaging with the adjust lever at a position spaced from the accelerator shaft to bias it in a rotation tangential line direction of the adjust lever, and sets and fixes a rotation position of the adjust lever by the rotational driving mechanism.

The valve driving apparatus of the present invention is characterized in that the rotational driving mechanism is placed at an outside of the cylinder head or the cylinder head cover or a location thereof near the outside.

The valve driving apparatus of the present invention is characterized in that the rotational driving mechanism is supported and placed on the accelerator fork.

The internal combustion engine of the present invention is an internal combustion engine constituted to control intake and exhaust by intake valves and exhaust valves, respectively, and is characterized in that any one of the above-described valve driving apparatuses is included at an intake side or an exhaust side.

According to the present invention, continuously variable control of the valve lift amount and the operation angle is performed in accordance with the accelerator opening in this type of engine. In this case, the adjust mechanism for finely adjusting the relative position in the axial direction of the accelerator fork with respective to the accelerator shaft is included, and this adjust mechanism is rotatably supported on the accelerator shaft, and has an adjust lever engaging with the accelerator fork to move it slightly in the axial direction of the accelerator shaft. When the valve lift amount is finely adjusted, or tuning of the cylinders is performed in the multi-cylinder engine, the rotating movement of the adjust lever can be handled from the outside of the cylinder head or the cylinder head cover.

DETAILED DESCRIPTION OF THE PREFERRED EMBODIMENTS

A preferred embodiment according to the present invention will be explained hereinafter based on the drawings.

Figure 1:
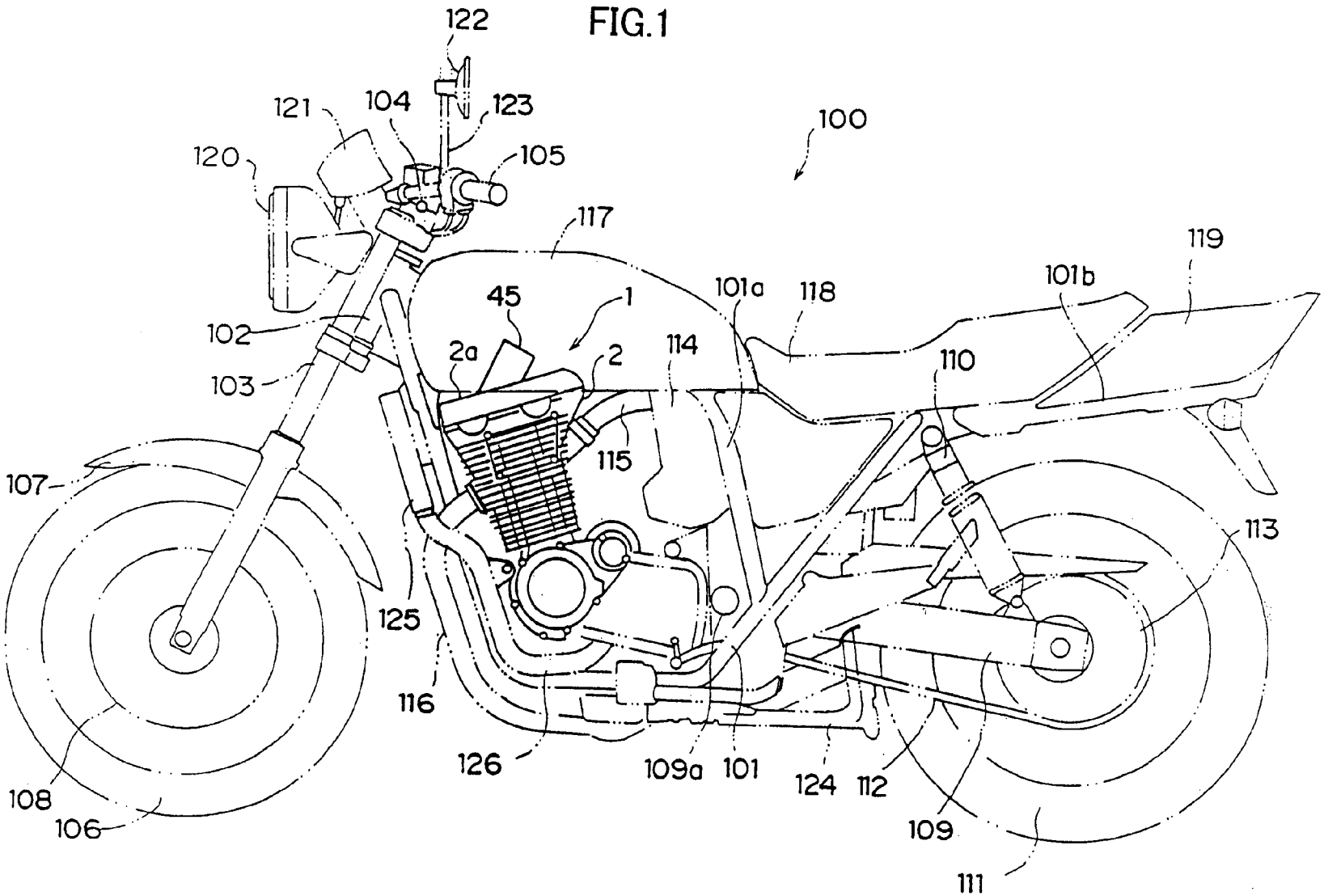
FIG. 1 is a view showing a constitution example of a motorcycle including an engine and its peripheral part according to an application example of the present invention.

A valve driving mechanism according to the present invention is effectively applicable to various types of gasoline engines loaded on motorcycles or four-wheeled automobiles, and in this embodiment, an engine of a motorcycle, for example, as shown in FIG. 1 is taken as an example.

First, an entire constitution of a motorcycle 100 according to this embodiment will be explained. In FIG. 1, two front forks 103 supported rotatably clockwise and counter-clockwise by a steering head pipe 102 are provided at a front part of a vehicle body frame 101 made of steel or an aluminum alloy material. A handle bar 104 is fixed to top ends of the front forks 103, and grips 105 are equipped at both ends of the handle bar 104. A front wheel 106 is rotatably supported at a lower part of the front fork 103, and a front fender 107 is fixed to cover an upper portion of the front wheel 106. The front wheel 106 has a brake disc 108 which rotates integrally with the front wheel 106.

A swing arm 109 is swingably provided at a rear part of the vehicle body frame 101, and a rear shock absorber 110 is mounted between the vehicle body frame 101 and the swing arm 109. A rear wheel 111 is rotatably supported at a rear end of the swing arm 109, and the rear wheel 111 is rotationally driven via a driven sprocket 113 with a chain 112 wound around it.

A mixture is supplied to an engine unit 1 (solid line portion) loaded on the vehicle body frame 101 from an intake pipe 115 connected to an air cleaner 114, and an exhaust gas after combustion is exhausted through an exhaust pipe 116. The air cleaner 114 is placed behind the engine unit 1 and in a large space under a fuel tank 117 and a sheet 118 for securing a volumetric capacity. Consequently, the intake pipe 115 is connected to a rear side of the engine unit 1, and the exhaust pipe 116 is connected to a front side of the engine unit 1. The fuel tank 117 is loaded at an upper position from the engine unit 1, and the seat 118 and a seat cowl 119 are connectively provided behind the fuel tank 117.

Here, an accelerator motor 45 which will be described later is mounted to a predetermined region of a cylinder head 2 or a cylinder head cover 2*a* of the engine unit 1. The accelerator motor 45 is projectingly provided from a top surface of the cylinder head cover 2*a*, for example, as shown in the example in the drawing. In this case, an accelerator motor 45 is placed in a recessed portion provided at a lower part of the fuel tank 117, so that the fuel tank 117 and the cylinder head cover 2*a* are placed not to interfere with each other.

The accelerator motor 45 can be placed at either the intake side or the exhaust side with use of a link, but if it is provided at the exhaust side, the recessed portion formed on the fuel tank 117 is exposed, and the outer appearance becomes worse as it is. Consequently, in consideration of this, it is more preferable to provide the acceleration motor 45 at the intake side.

Further, in FIG. 1, reference numeral 120 denotes a head lamp, reference numeral 121 denotes a meter unit including a speed meter, a tachometer, various kinds of indicator lamps or the like, and reference numeral 122 denotes a rear-view mirror supported by a handle bar 104 via a stay 123. A main stand 124 is swingably attached to a lower part of the vehicle body frame 101, which allows the rear wheel 111 to contact the ground and lift from the ground. The vehicle body frame 101 is provided to extend from the head pipe 102 provided at the front part to a diagonally downward to the rear, and after it is bent to wrap a portion under the engine unit 1, it forms a pivot 109*a* which is a pivoted portion of the swing arm 109, and connects to a tank rail 110*a* and a seat rail 101*b*.

This vehicle body frame 101 is provided with a radiator 125 in parallel with the vehicle body frame to avoid interference with the front fender 107, and a cooling water hose 126 is placed along the vehicle body frame 101 from this radiator 125 and communicates with the engine unit 1 without interfering with the exhaust pipe 116.

Figure 2:
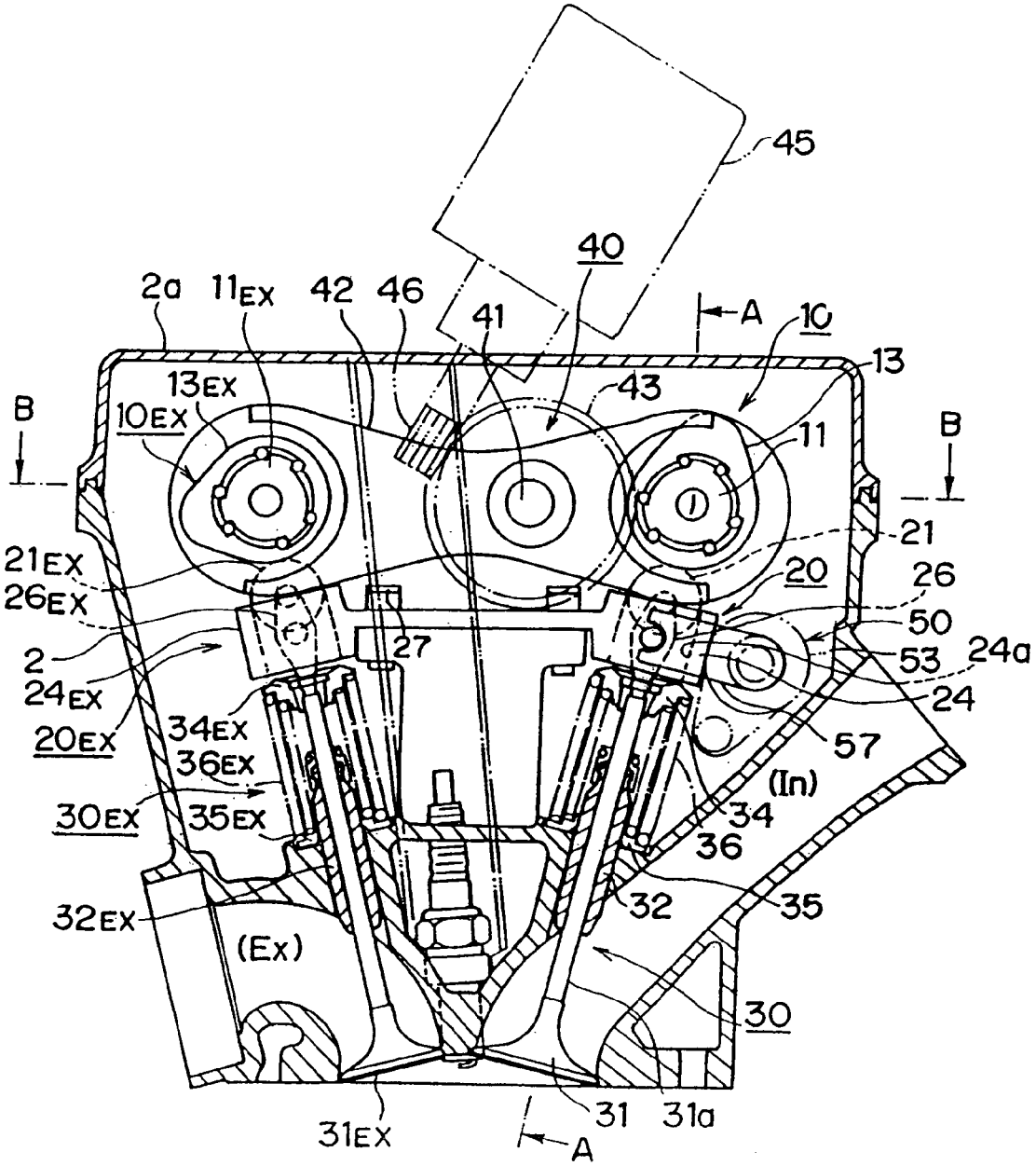
FIG. 2 is a sectional view of a side of an essential part of a valve driving apparatus of the present invention.
Figure 3:
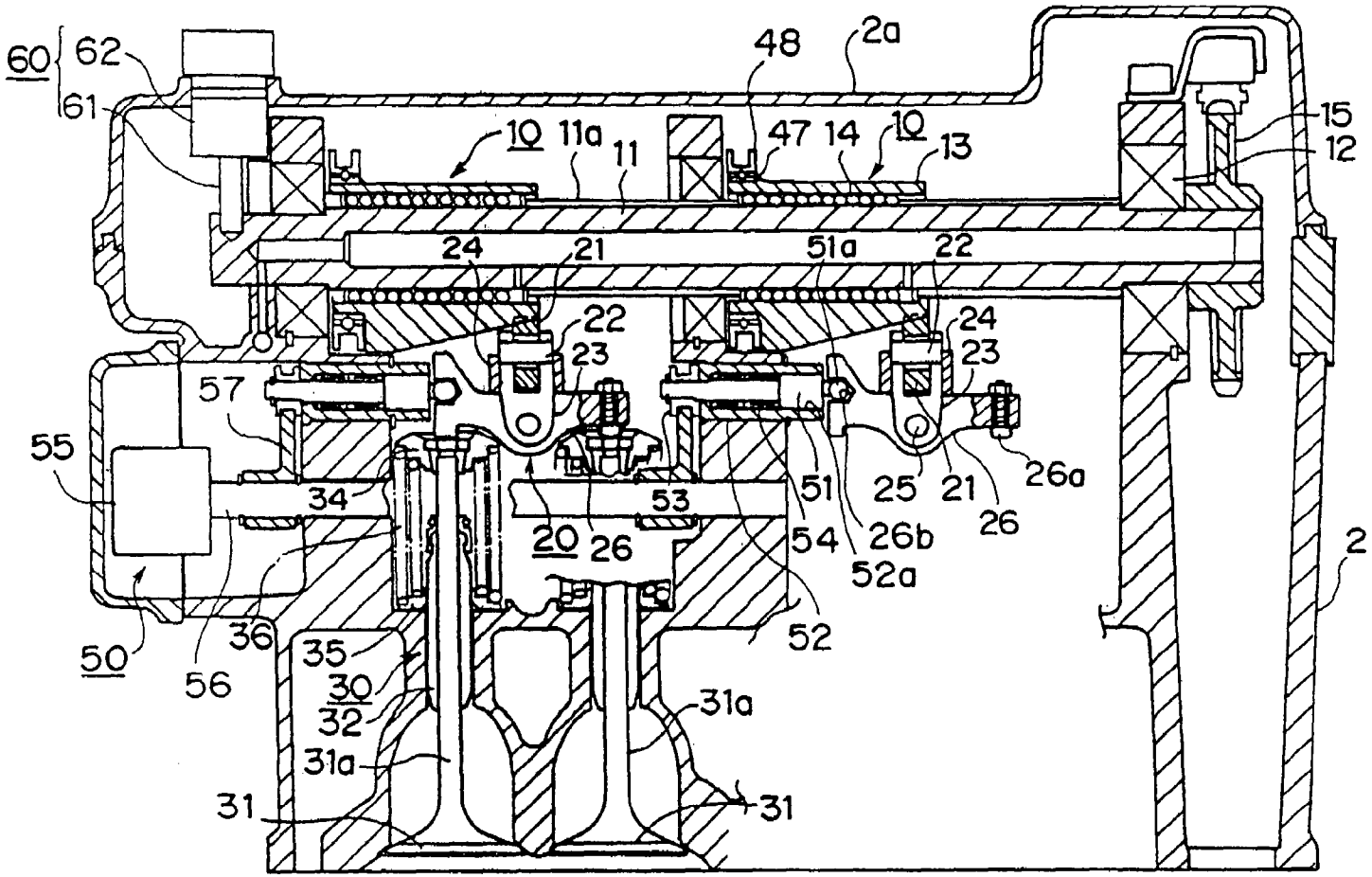
FIG. 3 is a sectional view taken along the line A—A in FIG. 2.
Figure 4:
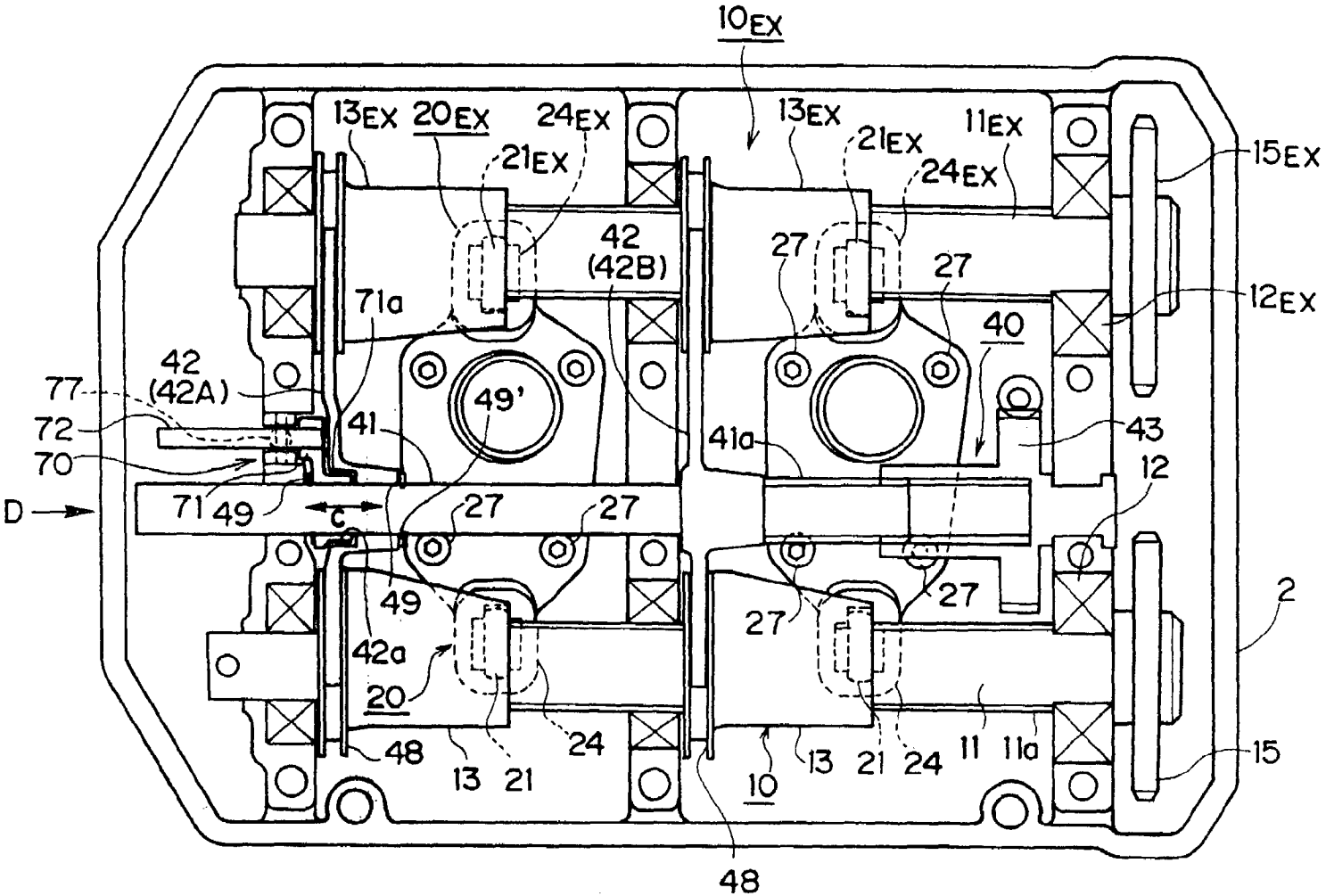
FIG. 4 is a sectional view taken along the line B—B in FIG. 2.

Next, FIG. 2 is a sectional view of a side of an essential part of the apparatus of the present invention, FIG. 3 is a sectional view taken along the line A to A in FIG. 2, and FIG. 4 is a sectional view taken along the line B—B in FIG. 2. In this embodiment, a parallel two-cylinder engine is used, and it has two valves for each of the intake side (IN) and the exhaust side (EX) of each cylinder (namely, four valves in all). It has a three-dimensional cam at both the intake side and the exhaust side of each of the cylinders, and in this case, an accelerator shaft is placed between the intake side camshaft and the exhaust side camshaft to drive the cams at the intake side and the exhaust side via an accelerator fork provided at this accelerator shaft. A cylinder head 2 is placed at an upper portion of the piston which reciprocates up and down inside the cylinder in the engine unit 1, and the valve driving apparatus of the present invention is housed in this cylinder head 2.

First, at the intake side, the valve driving apparatus of this embodiment includes a cam/camshaft unit 10 placed along the arranging direction of the cylinder, a valve lifter unit 20 placed at an underside of the cam/camshaft unit 10, a valve unit 30 for performing an intake control, an accelerator shaft unit 40 for displacing the cam of the cam/camshaft unit 10 in accordance with accelerator opening, and a valve stopping unit 50 for stopping the valve as necessary.

At the exhaust side, the apparatus includes a cam/camshaft unit $\mathbf{10}_{EX}$ constituted substantially similarly to the intake side, the valve lifter unit $\mathbf{20}_{EX}$ placed at an underside of the cam/camshaft unit $\mathbf{10}_{EX}$, and a valve unit $\mathbf{30}_{EX}$ for performing an exhaust control. The apparatus does not include a valve stopping unit at the exhaust side. The intake side will be mainly explained concerning these units hereinafter, and the exhaust side has the same constitution.

A cam 13 and a cam $\mathbf{13}_{EX}$ of the cam/camshaft unit 10 and the cam/camshaft unit $\mathbf{10}_{EX}$ is constituted so as to control valve lift amounts, actuated angles and lift timings of an intake valve 31 and an exhaust valve $\mathbf{31}_{EX}$ to be continuously variable. In this embodiment, an accelerator shaft unit 40 placed between the cam/camshaft unit 10 at the intake side and the cam/camshaft unit $\mathbf{10}_{EX}$ at the exhaust side is commonly used at the intake side and the exhaust side.

In the cam/camshaft unit 10, a camshaft 11 is rotatably supported at the cylinder head 2 via a bearing 12 (FIG. 3). The cam 13 which will be described later is mounted to the camshaft 11 slidably in an axial direction thereof, and in this example, the camshaft 11 has a ball spline 11*a* with three threads, for example, and by this guide, the camshaft 11 linearly moves (linear-motion) via the balls 14. The camshaft 11 has a hollow structure, and a lubricant oil path is formed in its hollow interior part to make it possible to fill oil to the cam 13 and the like.

Figure 5:
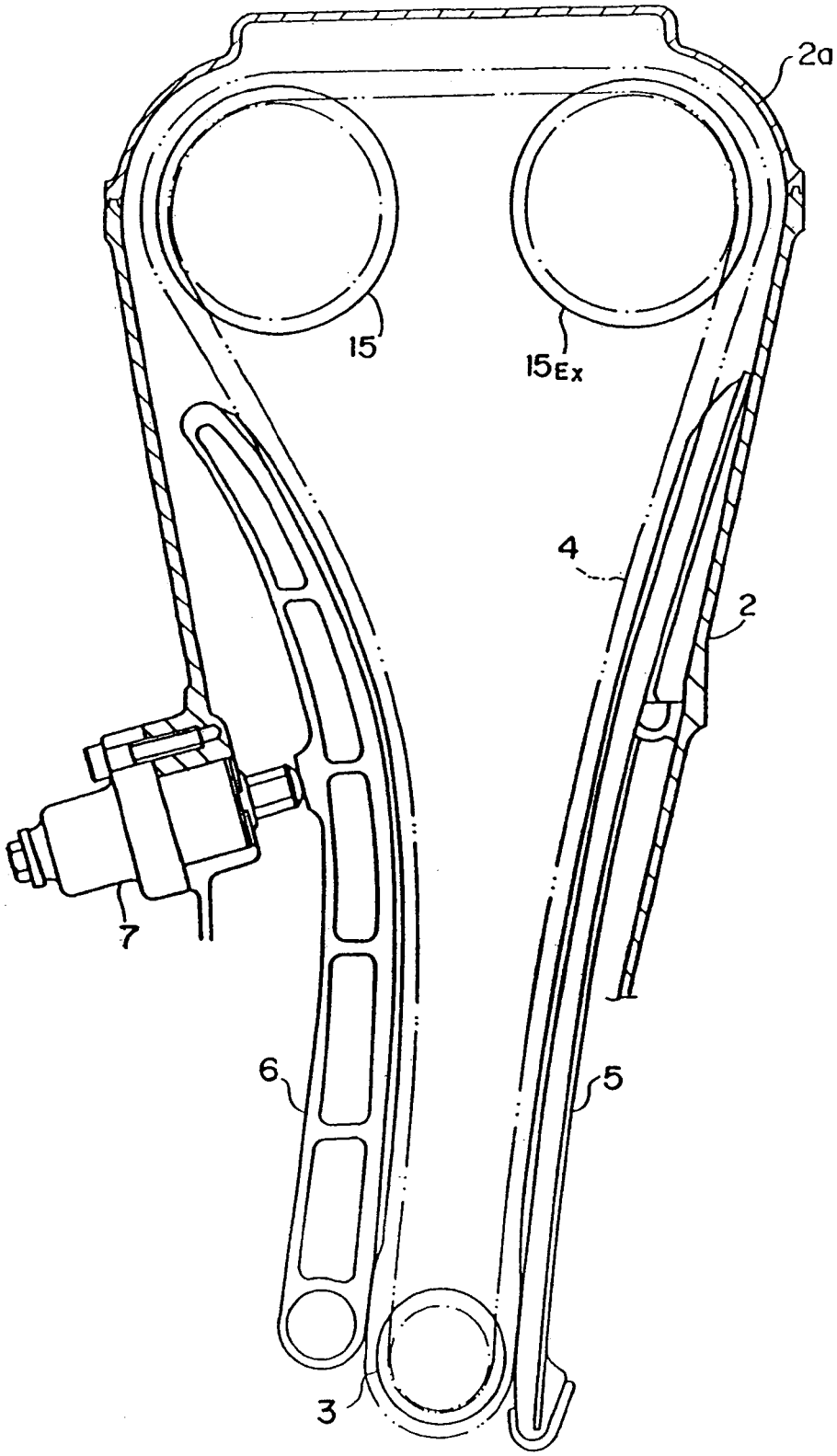
FIG. 5 is a view showing a rotationally driving system of a camshaft according to a valve driving apparatus of the present invention.

A sprocket 15 is fixed to one end of the camshaft 11. A sprocket $\mathbf{15}_{EX}$ is also fixed to one end of the camshaft $\mathbf{11}_{EX}$ at the exhaust side, and as shown in FIG. 5, a cam chain 4 is mounted to be wound around the sprockets 15 and $\mathbf{15}_{EX}$ and a drive sprocket 3 fixed to one end of the crankshaft (not shown). As shown in FIG. 5, a chain guide 5, a chain tensioner 6, a tensioner adjuster 7 and the like are included, and thereby, the cam chain 4 properly travels.

Here, the cam 13 and the cam $\mathbf{13}_{EX}$ are constituted as "three-dimensional cams", and they are provided at the intake side and the exhaust side of each of the cylinders one by one. As shown in FIG. 3 or FIG. 4, a cam portion gradually inclined in a longitudinal direction (axial direction of the camshaft 11) is extensively provided, and is formed into a shape to change the valve lift amount continuously. In this case, it is set such that the cam operation angle and lift timing are changed synchronously with the cam height, namely, the cam operation angle becomes larger as the valve lift amount becomes larger, and further the lift timing of the valve is also capable of being changed.

Next, in the valve lifter unit 20, a tappet roller 21 supported at a pin 22 so as to contact the cam 13 is included. The pin 22 is fixed to a slider 23 in parallel with the camshaft 11, and rotatably supports the tappet roller 21 via a needle bearing. The tappet roller 21 is placed inside the slider 23 so as not to slide in an axial direction of the pin 22. The slider 23 has a rectangular shape in section, and is slidably fitted into a guide hole 24*a* (FIG. 2) formed in a tappet holder 24.

The guide hole 24*a* is formed along an axial direction of a valve stem, and thereby the tappet roller 21 is held to float in such a manner as to be housed inside the tappet holder 24 via the slider 23, and is movable only in the axial direction of the valve stem. This valve lifter unit 20 (tappet roller 21) functions as a valve lifter which is pressed by a cam surface of the cam 13 to advance and retreat the valve.

A pin 25 is supported at a lower portion of the slider 23 to be orthogonal to the pin 22, and a balance-shaped arm member 26 (swing arm) is swingably held at this pin 25 via a needle bearing. At both ends of the balance-shaped arm member 26, pressing portions 26*a* which abut to a valve stem 31*a* are provided, and a fitting recessed portion 26*b* constituted as an engaging portion with a tappet stopper 51 is included on an outer surface thereof. One of the pressing portions 26*a* of both ends of the balance-shaped arm member 26 is constituted to be adjustable in height.

In this example, the pin 25, which is a swing support point of the balance-shaped arm member 26, is placed to be off-set downward with respect to a center (pin 22) of the tappet roller 21. By being off-set like this, the balance-shaped arm member 26 is in a shape which is bent to be projected downward as shown in FIG. 3. When the balance-shaped arm member 26 is not restrained by the tappet stopper 51, it moves up and down with parallelism being kept with the camshaft 11. When the balance-shaped arm member 26 is restrained by the tappet stopper 51, it becomes swingable with the fitting recessed portion 26*b* as the support point.

The tappet holder 24 of the valve lifter unit 20 (and the valve lifter unit $\mathbf{20}_{EX}$) is fixed to the cylinder head 2 by four bolts 27 in this example, as shown in FIG. 4.

In the valve unit 30, two of the intake valves 31 in which respective valve stems 31*a* are guided by valve guides 32 are included. An end portion of each valve stem 31*a* abuts to the pressing portion 26*a* of the balance-shaped arm member 26, and a valve spring 36 is mounted between a valve retainer 34 and a spring seat 35.

Here, the cam/camshaft unit $\mathbf{10}_{EX}$, the valve lifter unit $\mathbf{20}_{EX}$ and the valve unit $\mathbf{30}_{EX}$ at the exhaust side have the same basic constitution as the respective units at the intake side as described above, but the concrete specifications of the cam $\mathbf{13}_{EX}$ of the cam/camshaft $\mathbf{10}_{EX}$ differ from those of the cam 13.

The accelerator shaft unit 40 includes an accelerator shaft 41 placed in parallel with the camshaft 11 and the camshaft $\mathbf{11}_{EX}$, and an accelerator fork 42 fixed to the accelerator shaft 41 and connected to the cam 13 and the cam $\mathbf{13}_{EX}$. The accelerator shaft 41 is supported by the cylinder head 2 slidably in its axial direction, and engaged with a driven gear 43 (wheel) via a torsion spline 41*a* at one end side. The driven gear 43 is rotatably supported by the cylinder head 2, and is meshed with a drive gear 46 (worm) fixed to an output shaft of an accelerator motor 45.

The accelerator fork 42 extends to the sides of the camshaft 11 and the camshaft $\mathbf{11}_{EX}$ in a perpendicular direction to the accelerator shaft 41, and tip end portions each in a bifurcated shape are engaged with fork guides 48 rotatably mounted to end portions of the cam 13 and the cam $\mathbf{13}_{EX}$. As a result, the cam 13 and the cam $\mathbf{13}_{EX}$ slide along the camshaft 11 and the camshaft $\mathbf{11}_{EX}$ interlocked with or synchronously with the accelerator shaft 41 sliding in its axial direction.

Here, as will be described later, the accelerator fork 42 has its position in the axial direction relative to the accelerator shaft 41 finely adjusted by an adjust mechanism. In this case, one accelerator fork 42 (42A) is mounted to be slidable in the axial direction of the accelerator shaft 41 by a very small stroke. This accelerator fork 42A is restrained in its position by circlips (fasteners) 49 from both sides. A disc spring 49' is mounted to between one of the circlips 49 (what is placed at the right side of the accelerator fork 42 in FIG. 4) and an end surface of the accelerator fork 42, so that backlash in the axial direction does not occur. The other accelerator fork 42 (42B) is fixed at a predetermined position in the axial direction of the accelerator shaft 41.

The valve stop unit 50 has the tappet stopper 51 constituted to stop one of the two intake valves 31. The tappet stopper 51 is inserted in a guide hole 52*a* of a sleeve 52 mounted to the cylinder head 2, and is slidable in parallel with the camshaft 11. The tappet stopper 51 has a spherical stopper portion 51*a* capable of engaging with the fitting recessed portion 26*b* of the balance-shaped arm member 26, at one end, and a fork guide 53 with which a fork which will be described later is engaged is attached to the other end. A return spring 54 for biasing the stopper portion 51*a* to the fitting recessed portion 26*b* of the balance-shaped arm member 26 is fitted in the guide hole 52*a*.

A drive device 55 is placed in parallel with the camshaft 11, and advances and retreats a drive shaft 56 for driving (retreating drive) the tapped stopper 51. A fork 57 is connected to the drive shaft 56, and the fork 57 is engaged with the fork guide 53 of the tappet stopper 51. Two of the tappet stoppers 51 are connected to each other by the drive shaft 56 to be operated synchronously with each other.

Here, a phase sensor unit 60 is provided at the other end of the camshaft 11. The phase sensor unit 60 includes a pin 61 implanted at the other end of the camshaft 11 and a phase sensor 62 which detects this pin 61 and obtains an output signal.

The apparatus of the present invention further has the adjust mechanism for finely adjusting a relative position in the axial direction of the accelerator fork 42 with respect to the accelerator shaft 41. In this embodiment, the engine unit 1 is constituted by two parallel cylinders, and has an adjust mechanism 70 at the side of the accelerator fork 42 (42A) of one of the cylinders as shown in FIG. 4. This adjust mechanism 70 has an adjust lever 71 rotatably supported on the accelerator shaft 41, and engaging with the accelerator fork 42 to move it slightly in the axial direction of the accelerator shaft 41. A position in an axial direction of the accelerator fork 42 is finely adjusted by a rotating movement of the adjust lever 71.

The adjust lever 71 is screwed into a screw portion 42*a* of the accelerator fork 42 at a screw portion 71*a* formed along an outer periphery of a fitting portion to the accelerator shaft 41, whereby when the adjust lever 71 is rotated, the accelerator fork 42 slides in the axial direction of the accelerator shaft 41 as shown by the arrow C. As will be described later, in the valve driving apparatus of the present invention, the rotating movement of the adjust lever 71 is constituted to be capable of being handled from an outside of the cylinder head cover 2*a*.

Figure 6:
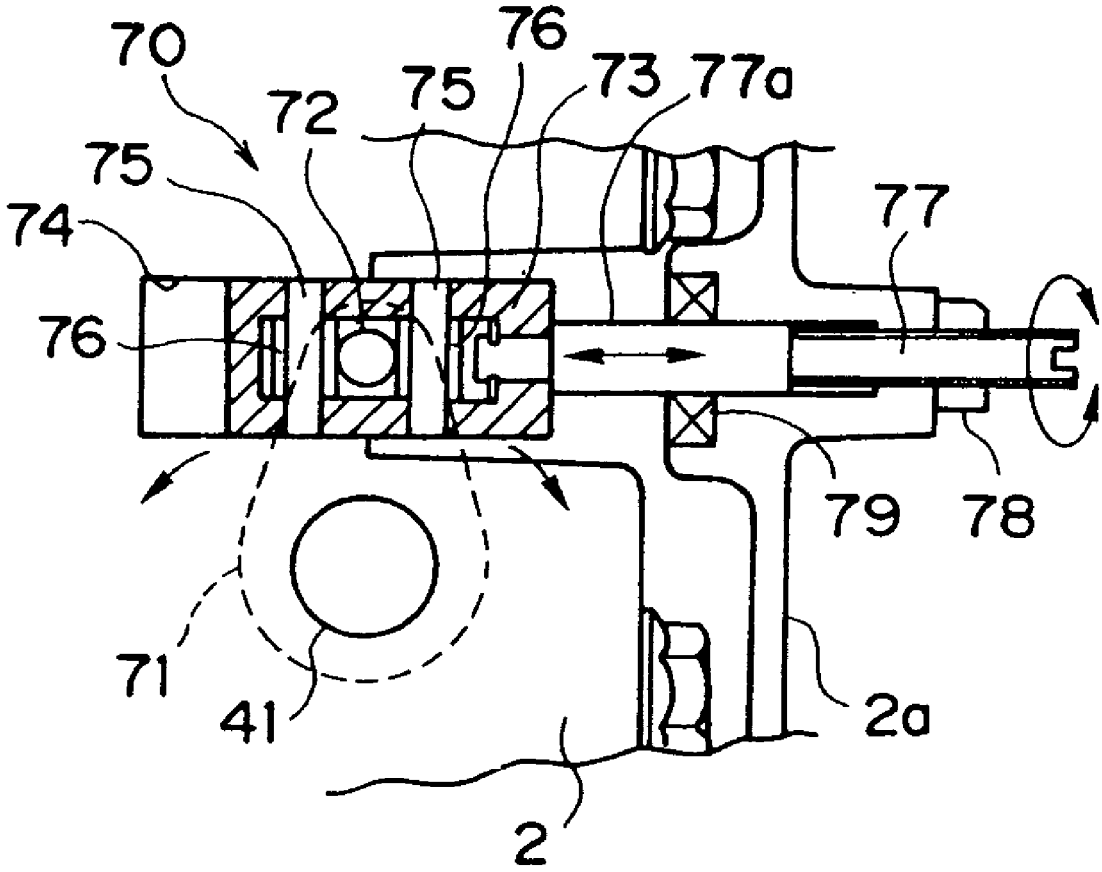
FIG. 6 is a view showing an adjust mechanism and its peripheral part according to a first embodiment of the valve driving apparatus of the present invention, seen from the arrow D in FIG. 4.

FIG. 6 (FIG. 4 seen from the arrow D) shows the adjust mechanism 70 and its peripheral part in this embodiment. The adjust mechanism 70 has a rotational driving mechanism for engaging with the adjust lever 71 at a position spaced from the accelerator shaft 41 to bias it in a rotation tangential direction of the adjust lever 71. The rotation position of the adjust lever 71 is set and fixed by the rotational driving mechanism.

In FIG. 4 and FIG. 6, a guide pin 72 is implanted at an end portion of the adjust lever 71 in parallel with the accelerator shaft 41. The end portion of the accelerator shaft 41 is supported by the cam holder 2*b* for fixing the supporting bearing 12 of the camshaft 11. The guide pin 72 is engaged with a holder 73 for setting and fixing a phase (rotational angle) of the adjust lever 71. The holder 73 is guided to slide by a recessed guide portion 74 formed at the cylinder head 2, and is capable of reciprocating in an up-and-down direction of the cylinder head 2 in this example. The guide pin 72 and the holder 73 are engaged with each other via a pair of rollers 76 rotatably mounted to pins 75 at both sides of the guide pin 72.

The holder 73 is reciprocated by an operation of an adjust screw 77 as the aforementioned rotational driving mechanism in the rotation tangential line direction of the adjust lever 71. Namely, the adjust screw 77 is screwed into the cylinder head cover 2*a* along the rotation tangential line direction of the adjust lever 71, and a spindle portion 77*a* integrally formed is rotatably connected to the holder 73 at its end portion. In this case, the adjust screw 77 is fixable to the cylinder head cover 2*a* by a lock nut 78. The end portion of the spindle portion 77*a* is locked by an E-ring or the like so that the holder 73 does not come off, and an oil seal 79 is attached to the spindle portion 77*a*.

In the above-described constitution, when an accelerator grip (or accelerator pedal) is operated, the accelerator motor 45 is operated, and the accelerator shaft 41 is slid by rotation of its output shaft. The cam 13 and the cam $\mathbf{13}_{EX}$ slide along the camshaft 11 and the camshaft $\mathbf{11}_{EX}$ interlocked with the movement of the accelerator shaft 41 via the accelerator fork 42. In this embodiment, the continuously variable control of the valve lift amount and the operation angle is also performed in accordance with the accelerator opening at the exhaust side in addition to the intake side. As described above, the intake and exhaust amount are controlled from the idle rotation range to the fully opened range, and the optimal intake and exhaust for the engine speed can be performed.

For example, at a low engine speed, the tappet roller 21 abuts to the cam 13 at a lower region in cam height as shown in FIG. 3. When acceleration is performed, namely, when the accelerator is opened, the driven gear 43 is rotated by the operation of the accelerator motor 45, and the accelerator shaft 41 slides in a rightward in the drawing. The cam 13 also slides rightward in the drawing along the camshaft 11, interlocked with the movement of the accelerator shaft 41 via the accelerator fork 42. The tappet roller 21 gradually abuts to a higher region of the cam height by the slide of the cam 13, whereby the valve lift amount increases following a predetermined lift characteristic. Meanwhile, at a time of deceleration, the accelerator is returned, whereby the valve lift amount is decreased by the reverse operation from the above description.

Especially according to the adjust mechanism 70 in the apparatus of the present invention, the rotational movement of the adjust lever 71 is converted into the movement in an axial direction by the screw mechanism, and the position in the axial direction of the accelerator fork 42 can be finely adjusted. Namely, in this case, when the adjust screw 77 is rotated clockwise and counter-clockwise, the spindle portion 77*a* is advanced and retreated as shown by the arrows, whereby the holder 73 is biased in the rotation tangential line direction of the adjust lever 71. The adjust lever 71 is rotationally driven by the holder 73 via the guide pin 72. By the rotation of the adjust lever 71, the accelerator fork 42 screwed into this is finely adjusted in the axial position corresponding to the rotation amount or the angle of the adjust lever 71. This makes it possible to perform fine adjustment of the valve lift amount (intake boost) or tuning of the cylinders.

In this embodiment, the adjust screw 77 is screwed into the cylinder head cover 2*a*, namely, an adjust operation can be performed outside the cylinder head cover 2*a*, and therefore there is no need to take the trouble to remove the cylinder head cover 2*a* or the cylinder head 2. Accordingly, much time and efforts are not required for fine adjustment of the valve lift amount, and adjustment can be performed simply and properly. In this case, it becomes possible to perform fine adjustment with the intake boost by rotating the engine, and adjustment at the time of maintenance becomes extremely simplified since lubricant oil is not scattered.

The adjust mechanism 70 is included at the side of the accelerator fork 42A of one of the two parallel cylinders of the engine unit 1. Even when a set of the adjust mechanism 70 is omitted at the side of the accelerator fork 42B like this, tuning of the cylinders can be performed, and therefore cost, weight and the like can be reduced. In this case, rotation of the accelerator shaft 41 is restrained at the side of the accelerator fork 42B, and slide movement of the accelerator shaft 41 can be performed via the torsion spline 41*a*.

Since the adjust operation can be performed with the one adjust screw 77 (and the lock nut 78) screwed into the cylinder head cover 2*a* as described above, the number of man-hours for adjustment can be reduced. Adjustment by the automatic adjusting mechanism is more easily realizable, and in this case, it is possible to increase adjustment accuracy. Further, if a proper actuator is applied to the adjust screw 77 and the lock nut 78 portion, fine adjustment and tuning can be always carried out at the time of operating the engine. Consequently, durability and accuracy for tuning are increased, and it is possible to realize the engine with less endurance deterioration with respect to exhaust gas, fuel consumption performance, or the like.

Further, in the concrete constitution of the present invention, the guide pin 72 and the holder 73 are engaged with each other via a pair of rollers 76 rotatably mounted to the pin 75 as described above. By thus engaging them via the rollers 76, it is possible to reduce slide resistance between the guide pin 72 and the holder 73, and reduce slide resistance of the accelerator shaft 41 itself. Accordingly, the operation of the accelerator motor 45 is made smooth, and the driving electric power is substantially reduced.

The holder 73 is guided to slide so as not to rotate, by the recessed guide portion 74 (U-shaped groove) formed at the cylinder head 2, whereby the space is saved and the constitution is simplified. Namely, when the holder 73 is restrained from rotating and guided to slide by, for example, the guide shaft or the like, a space is needed in the axial direction of the adjust screw 77, and accuracy in a pitch and parallelism between two or more of the guide shafts is needed, thus requiring high machining and press-fitting accuracy, and the like. In the present invention, the recessed guide portion 74 is provided at the cylinder head 2 itself, and therefore it can be formed more easily by the machining means such as milling.

In the adjust mechanism 70 of the above-described embodiment, the example having the adjust screw 77 as the rotational driving mechanism for biasing the adjust lever 71 in the rotation tangential line direction, but instead of such screw means, for example a rack and pinion mechanism can be used.

Next, a second embodiment of the present invention will be explained. The same reference numerals and symbols as in the first embodiment are used for the members which are substantially the same as or corresponding to those in the first embodiment.

Figure 7:
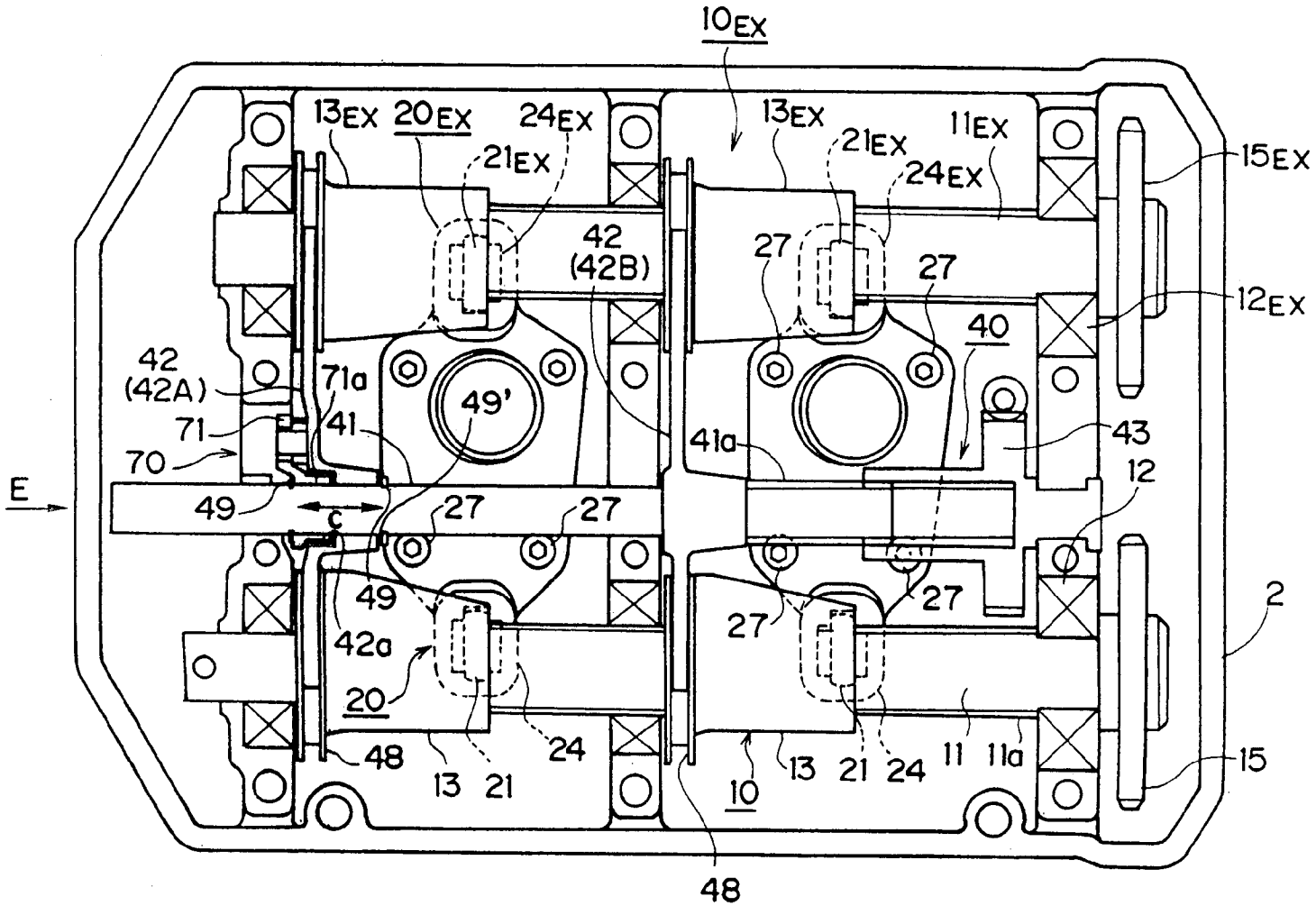
FIG. 7 is a plan view according to a second embodiment of the valve driving apparatus of the present invention.

The basic constitution in this embodiment is substantially the same as in the case of the aforementioned first embodiment. Accordingly, as shown in FIG. 7, the adjust mechanism 70 is included at the side of the accelerator fork 42 (42A) of one of the cylinders. This adjust mechanism 70 has the adjust lever 71 rotatably supported on the accelerator shaft 41, and engaging with the accelerator fork 42 to move it slightly in the axial direction of the accelerator shaft 41. By the rotational movement of the adjust lever 71, the axial position of the accelerator fork 42 is finely adjusted.

The adjust lever 71 is screwed into the screw portion 42*a* of the accelerator fork 42 at the screw portion 71*a* formed along the outer periphery of the fitting portion to the accelerator shaft 41, whereby when the adjust lever 71 is rotated, the accelerator fork 42 slides in the axial direction of the accelerator shaft 41 as shown by the arrow C.

Figure 8A:
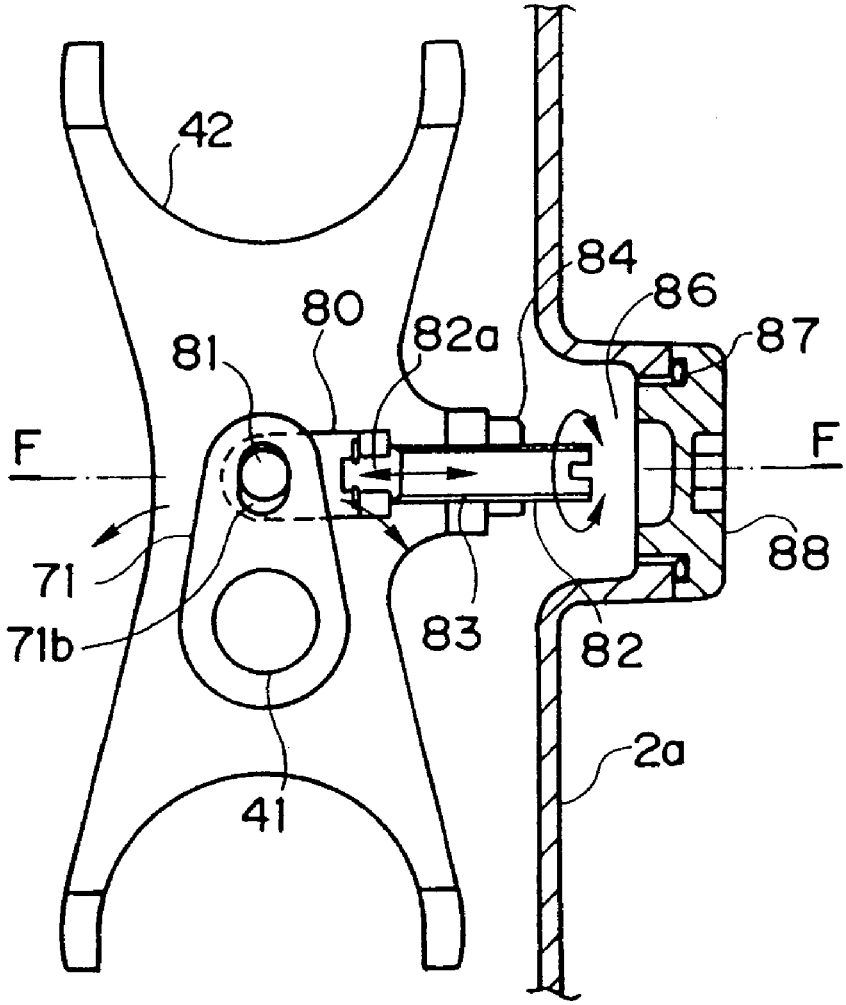
FIG. 8A is a view showing an adjust mechanism and its peripheral part according to the second embodiment of the valve driving apparatus of the present invention, seen from the arrow E in FIG. 7.

FIG. 8A (seen from the arrow E in FIG. 7) shows the adjust mechanism 70 and its peripheral part in this embodiment. The adjust mechanism 70 has the rotational driving mechanism engaged with the adjust lever 71 at the position spaced from the accelerator shaft 41 to bias it in the rotation tangential line direction of the adjust lever 71. The rotation position of the adjust lever 71 is set and fixed by the rotational driving mechanism, but in this embodiment, the rotational driving mechanism is specially supported and placed on the accelerator fork 42.

Figure 8B:
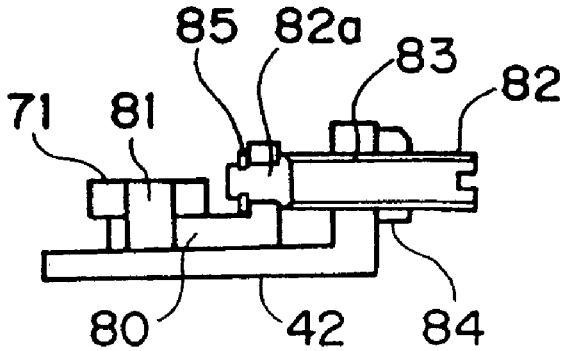
FIG. 8B is a sectional view taken along the line F—F in FIG. 8A.

In FIGS. 8A and 8B, a long hole 71*b* is formed at the end portion of the adjust lever 71, and a pin 81 implanted at a holder 80 is fitted into the long hole 71*b*. The holder 80 sets and fixes the phase (rotation angle) of the adjust lever 71, and is slidably mounted between them in such a manner as is sandwiched by the accelerator fork 42 and the adjust lever 71 as shown in FIG. 8B. An adjust screw 82 is screwed into a screw portion 83 formed to be raised at one portion of the accelerator fork 42 along the rotation tangential line direction of the adjust lever 71, and rotatably connected to the holder 80 at an end portion 82*a* thereof.

The holder 80 reciprocates in the rotation tangential line direction of the adjust lever 71 by the operation of the adjust screw 82 as the rotational driving mechanism. In this case, the adjust screw 82 is fixable to the accelerator fork 42 by a lock nut 84. The end portion 82*a* of the adjust screw 82 is locked by an E-ring or the like so that the holder 80 does not come off.

As shown in FIG. 8A, an opening 86 for operation is provided at a corresponding region in the cylinder head cover 2*a* to the adjust screw 82. A cap 88 is screwed onto the opening 86 via an O-ring 87.

In the second embodiment of the apparatus of the present invention, the adjust screw 82 is advanced and retreated as shown by the arrows by rotating the adjust screw 82 clockwise and counter-clockwise, whereby the holder 80 is biased in the rotation tangential line direction of the adjust lever 71. The adjust lever 71 is rotationally driven via the pin 81 by the holder 80. By rotation of the adjust lever 71, the accelerator fork 42 screwed into it is finely adjusted in the position in the axial direction corresponding to the rotation amount or the angle of the adjust lever 71. Thereby, fine adjustment of the valve lift amount (intake boost) or tuning of the cylinders can be performed.

Figure 9:
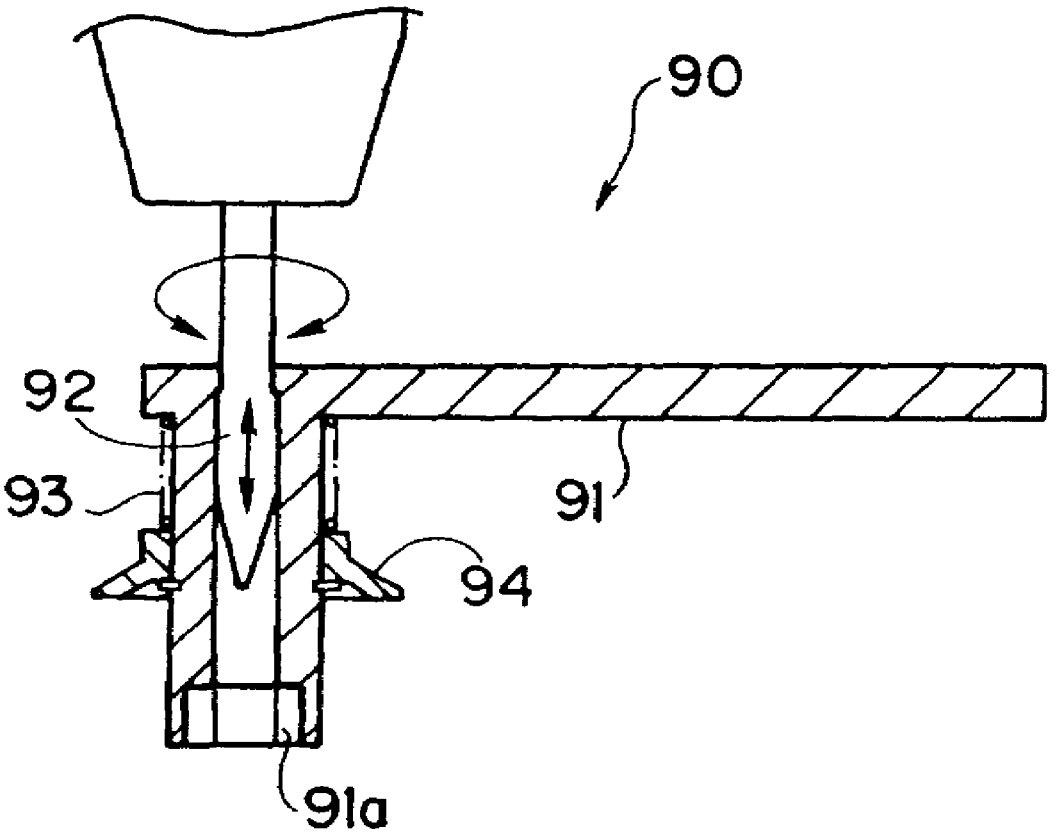
FIG. 9 is a view showing an example of a tuning tool according to the second embodiment of the valve driving apparatus of the present invention.

In this embodiment, the adjust operation can be efficiently performed by using a tuning tool 90 as shown in FIG. 9. Namely, the tuning tool 90 includes a box wrench 91 having an engaging portion 91*a* with the lock nut 84, and a driver 92 rotatably and slidably mounted to the box wrench 91, and is provided with an oil scattering prevention cap 94 elastically biased by a spring 93.

On the adjust operation, the cap 88 is removed and an oil scattering prevention cap 94 is applied to the opening 86. After the lock nut 84 is loosened by the box wrench 91, the adjust screw 82 is rotated clockwise or counter-clockwise by the driver 92. This rotates the adjust lever 71 by a desired angle, and thereafter the locknut 84 is fastened to fix the phase of the adjust lever 71.

In the second embodiment, the adjust operation can be also performed outside the cylinder head cover 2*a* without removing the cylinder head cover 2*a* or the cylinder head 2, and therefore adjustment-can be made simply and properly without requiring much time and efforts for fine adjustment of the valve lift amount.

Especially, in this example, the accelerator fork 42 and the adjust lever 71 are integrally fixed, and therefore an error caused by backlash and falling at the time of slide of the accelerator shaft 41 does not occur. Accordingly, they do not become resistance when the accelerator shaft 41 slides, and thus the driving force does not increase, in addition to that a tuning error does not occur. The structure of the adjust mechanism 70 is simple, and therefore cost, weight and the like can be reduced. In this case, the adjust screw 82 and its peripheral part are not exposed, and therefore the appearance is extremely favorable.

As described above, the holder 80 is mounted between the accelerator fork 42 and the adjust lever 71. Namely, the holder 80 can be guided from both sides by these members, and rotation prevention can be performed without using a special component. Accordingly, the constitution is also simplified in this respect.

The present invention is explained with the various embodiments thus far, but the present invention is not limited to only these embodiments, and modifications and the like can be made within the scope of the present invention.

For example, in each of the embodiments, the example in the case of two-cylinder engine is explained, but the present invention is also effectively applicable to an engine with a single cylinder, or three or more cylinders.

As explained thus far, according to the present invention, the continuously variable control of the valve lift amount, the operation angle and the lift timing is performed in accordance with the accelerator opening in this kind of valve driving apparatus. Since the adjust mechanism for finely adjusting the relative position in the axial direction of the accelerator fork with respect to the accelerator shaft is especially included, and the rotating movement of the adjust lever can be controlled from the outside of the cylinder head or the cylinder head cover in this case, the advantage of being capable of performing fine adjustment of the valve lift amount simply and efficiently and the like is provided.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A valve driving apparatus comprising a cam formed so that cam height and a cam operation angle continuously change, and constituted to be rotated integrally with a camshaft and relatively movable in an axial direction thereof, a valve lifter pressed by a cam surface of said cam to advance and retreat a valve, and an accelerator shaft unit for moving said cam in the axial direction of the camshaft, wherein said accelerator shaft unit comprises an accelerator shaft placed to be capable of reciprocating in the axial direction of the camshaft, and an accelerator fork supported at the accelerator shaft and engaging with said cam, and has an adjust mechanism for finely adjusting a relative position in an axial direction of the accelerator fork with respect to the accelerator shaft.

2. The valve driving apparatus according to claim 1, wherein the adjust mechanism has an adjust lever rotatably supported on the accelerator shaft and engaging with the accelerator fork to move it slightly in the axial direction of the accelerator shaft, and finely adjusts a position in an axial direction of the accelerator fork by rotating movement of the adjust lever.

3. The valve driving apparatus according to claim 2, wherein the adjust mechanism is constituted so that the rotating movement of the adjust lever is capable of being handled from an outside of a cylinder head or a cylinder head cover.

4. The valve driving apparatus according to claim 1, wherein the accelerator shaft is commonly used for at least two parallel cylinders, an accelerator fork placed at one of the cylinders is fixed to the accelerator shaft, and a position in an axial direction of the accelerator fork placed at the other cylinder is finely adjusted.

5. The valve driving apparatus according to claim 1, wherein the adjust mechanism has a rotational driving mechanism engaging with the adjust lever at a position spaced from the accelerator shaft to bias it in a rotation tangential line direction of the adjust lever, and sets and fixes a rotation position of the adjust lever by the rotational driving mechanism.

6. The valve driving apparatus according to claim 5, wherein the rotational driving mechanism is placed at an outside of the cylinder head or the cylinder head cover, or a location thereof near the outside.

7. The valve driving apparatus according to claim 5, wherein the rotational driving mechanism is supported and placed on the accelerator fork.

8. An internal combustion engine constituted to control intake and exhaust by intake valves and exhaust valves, respectively, wherein the valve driving apparatus according to claim 1 is included at an intake side or an exhaust side.

* * * * *